US012492560B2

(12) United States Patent
Nolt et al.

(10) Patent No.: US 12,492,560 B2
(45) Date of Patent: Dec. 9, 2025

(54) DUAL-AXIS SWIVEL BRACKET

(71) Applicant: Key-Link Fencing & Railing, Inc., New Holland, PA (US)

(72) Inventors: Dwight L. Nolt, Ephrata, PA (US); Michael A. Alexander, Smoketown, PA (US)

(73) Assignee: Key-Link Fencing & Railing, Inc., New Holland, PA (US)

( * ) Notice: Subject to any disclaimer, the term of this patent is extended or adjusted under 35 U.S.C. 154(b) by 276 days.

(21) Appl. No.: 18/488,518

(22) Filed: Oct. 17, 2023

(65) Prior Publication Data

US 2025/0122729 A1 Apr. 17, 2025

(51) Int. Cl.
*E04F 11/18* (2006.01)

(52) U.S. Cl.
CPC ... *E04F 11/1808* (2013.01); *E04F 2011/1887* (2013.01)

(58) Field of Classification Search
CPC ... E04F 11/18; E04F 11/1802; E04F 11/1804; E04F 11/1817; E04F 11/1834; E04F 2011/1819; E04F 2011/1821; E04H 17/1447; E04H 17/1448; E04H 17/1488
See application file for complete search history.

(56) References Cited

U.S. PATENT DOCUMENTS

| | | | | |
|---|---|---|---|---|
| 7,540,472 | B2 * | 6/2009 | Striebel | E04F 11/1817 256/65.15 |
| 10,513,854 | B2 * | 12/2019 | Timmons | E04F 11/1834 |
| 2009/0212271 | A1 * | 8/2009 | Platt | E04F 11/1817 256/65.03 |

FOREIGN PATENT DOCUMENTS

| | | | | |
|---|---|---|---|---|
| CA | 2631426 | A1 * | 11/2009 | E04F 11/1812 |
| DE | 3603717 | A1 * | 8/1987 | E04F 11/1834 |
| DE | 3641693 | A1 * | 6/1988 | E04F 11/1817 |
| DE | 9202724 | U1 * | 6/1992 | |
| DE | 4340286 | A1 * | 6/1995 | E04F 11/1851 |
| DE | 19506712 | A1 * | 9/1996 | E04F 11/1834 |
| EP | 0658665 | A1 * | 6/1995 | E04H 17/1448 |
| FR | 2874398 | A3 * | 2/2006 | E04H 17/1448 |
| GB | 2307256 | A * | 5/1997 | E04H 17/1448 |
| GB | 2461383 | A * | 1/2010 | E04F 11/184 |
| KR | 20030030731 | A * | 4/2003 | |
| KR | 20120033608 | A * | 4/2012 | E04F 11/1834 |
| KR | 101278582 | B1 * | 6/2013 | E04H 17/1448 |
| KR | 20130088983 | A * | 8/2013 | E04F 11/1817 |
| KR | 101490492 | B1 * | 2/2015 | E04H 17/1452 |

* cited by examiner

*Primary Examiner* — Jonathan P Masinick
(74) *Attorney, Agent, or Firm* — Saxton & Stump, LLC

(57) ABSTRACT

A dual-axis swivel bracket for a deck railing section is disclosed. The bracket is simultaneously adjustable along a first axis and a perpendicular second axis. When one end of the bracket is attached to a post and the other is attached to a rail, the position of the rail may be moved through a wide range of motion to allow for a wide range of installation designs.

10 Claims, 12 Drawing Sheets

DUAL-AXIS SWIVEL BRACKET

FIELD OF THE INVENTION

The present disclosure is generally directed to brackets having two axes of movement. More specifically, the subject matter of this application pertains to brackets for connecting railing posts and rails, in which the brackets can be adjusted along two axes.

BACKGROUND OF THE INVENTION

Although they share many features, railings and fences are different structures used for different purposes. Railings are typically a barrier or guardrail installed along the edge of a platform, staircase, or balcony to prevent people from falling. On the other hand, fences enclose an area or property to provide privacy and security or to define boundaries. In other words, railing is used as a safety measure along edges, while fencing is used to enclose an area or property.

Due to their different applications, railings and fences typically have much different building code and homeowner association requirements. For example, it is common for deck railing to be required to withstand 200 pounds of load applied in any direction at any point along the top rail. Other railings, such as may be used with a short walk up to a door or as a handrail on an internal stairway, may have less stringent requirements.

One thing all fencing and railing have in common is that anything that makes installation easier will be welcomed.

Deck railing comprises a horizontal top rail and a parallel bottom rail. These rails may be several feet long and attached to vertical posts on each end. Most deck rails will have vertical posts anchored to the deck every few feet to increase the strength of the railing. In addition, railing often comprises some infill between the top and bottom rails.

One of the challenges of deck railing installation is that the decks themselves may not be perfectly flat, and the vertical posts are not always perfectly plumb. These imperfections can make it challenging to install the railing while maintaining a consistent appearance. A slight discrepancy between two posts can make placing a horizontal post spanning those posts impossible to square. Additionally, the posts are not always perfectly parallel to each other. Accordingly, a rail attached to one post with a 90° bracket may not be able to be connected to another post with a 90° bracket . . . at least not without bending one or both brackets or shimming the brackets to offset the inconsistencies between the posts. This bending and shimming may correct a minor, aesthetic problem but introduce a more significant structural problem. Deviating from deck railing construction best practices can result in decreased strength. This weakened state of the railing won't be known until it fails, which could have tragic consequences and open the builder and manufacturer to liability.

A bracket is needed for constructing a deck railing that connects a deck post and a rail so that the rail can be positioned along two axes. Other features and advantages will be made apparent from the present specification. The teachings disclosed extend to those embodiments that fall within the scope of the claims, regardless of whether they accomplish one or more of the needs mentioned above.

SUMMARY OF THE INVENTION

The subject matter of this application is related to bracketing systems having two axes of rotation. More precisely, the subject matter of this application pertains to deck railing brackets used to connect posts and rails that allow the rails to be moved within a wide range of positions relative to a post to simplify installation.

The subject matter of this application pertains to adjustable bracketing systems that comprise two connection members, each being rotationally connected to an articulation member. The system allows for rotational movement along different axes between the articulation member and each connection member.

Other features and advantages of the present invention will be apparent from the following more detailed description of the preferred embodiment, taken in conjunction with the accompanying drawings which illustrate, by way of example, the principles of the invention.

BRIEF DESCRIPTION OF DRAWINGS

The same reference numbers will be used throughout the drawings to represent the same parts wherever possible.

DETAILED DESCRIPTION OF THE INVENTION

Figure 1:
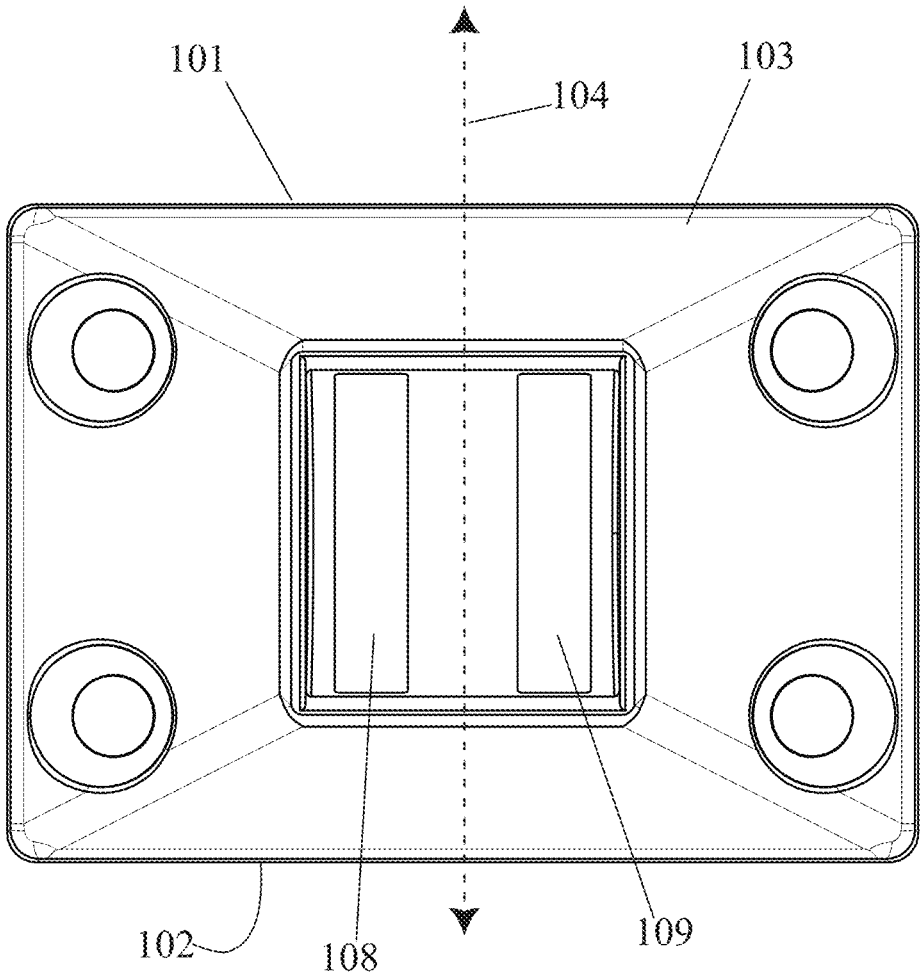
FIG. 1 is an illustration of a first connection member.
Figure 2:
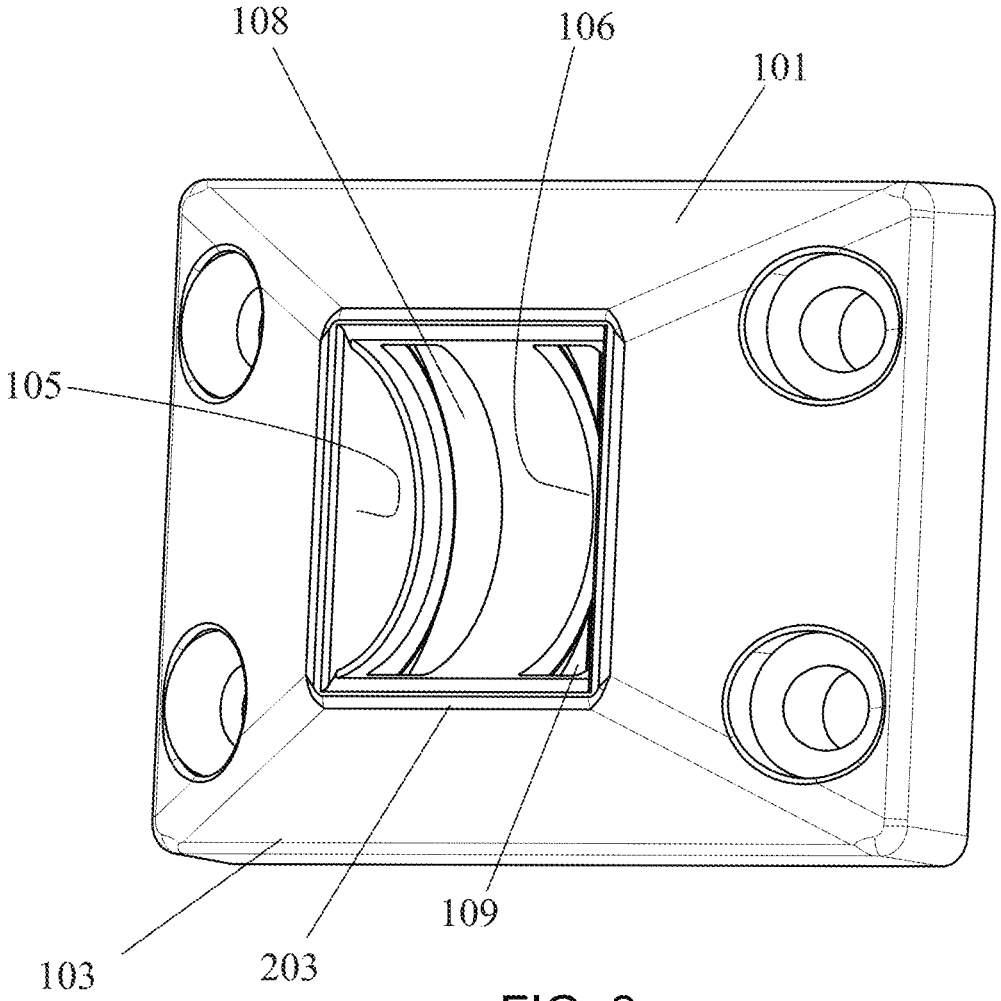
FIG. 2 is an illustration of another view of the first connection member.
Figure 3:
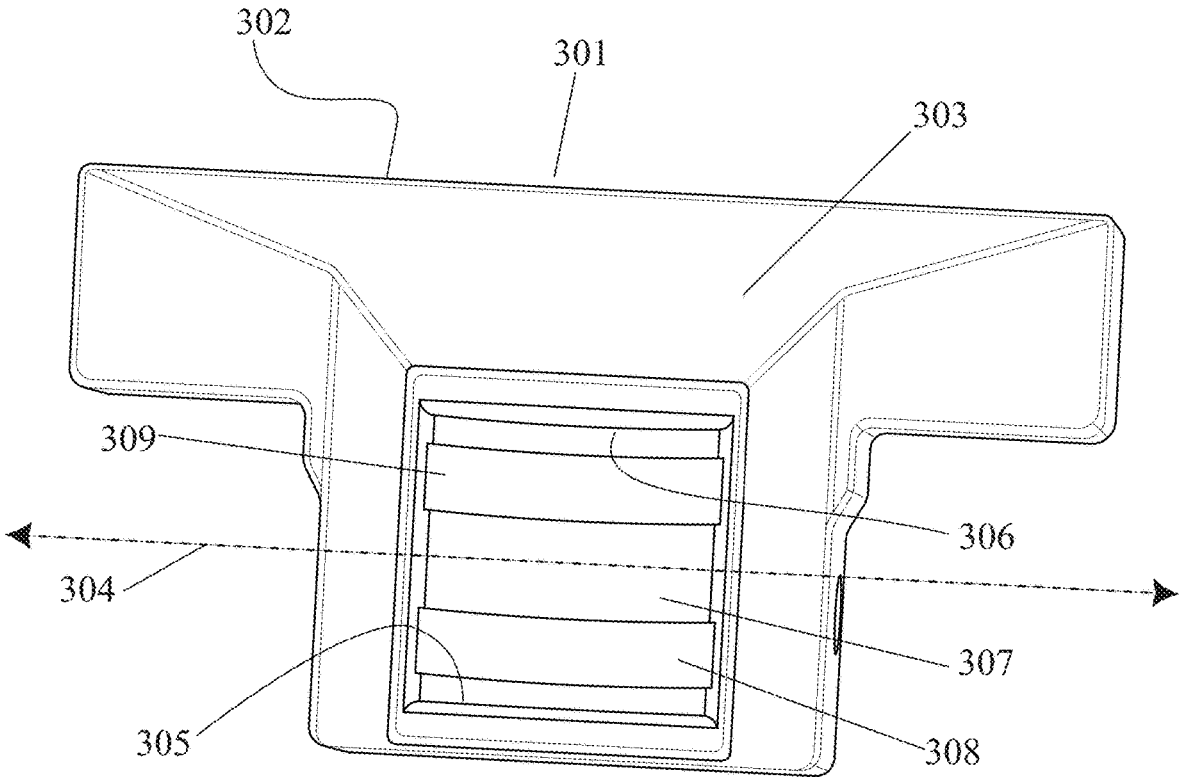
FIG. 3 is an illustration of a second connection member.
Figure 4:
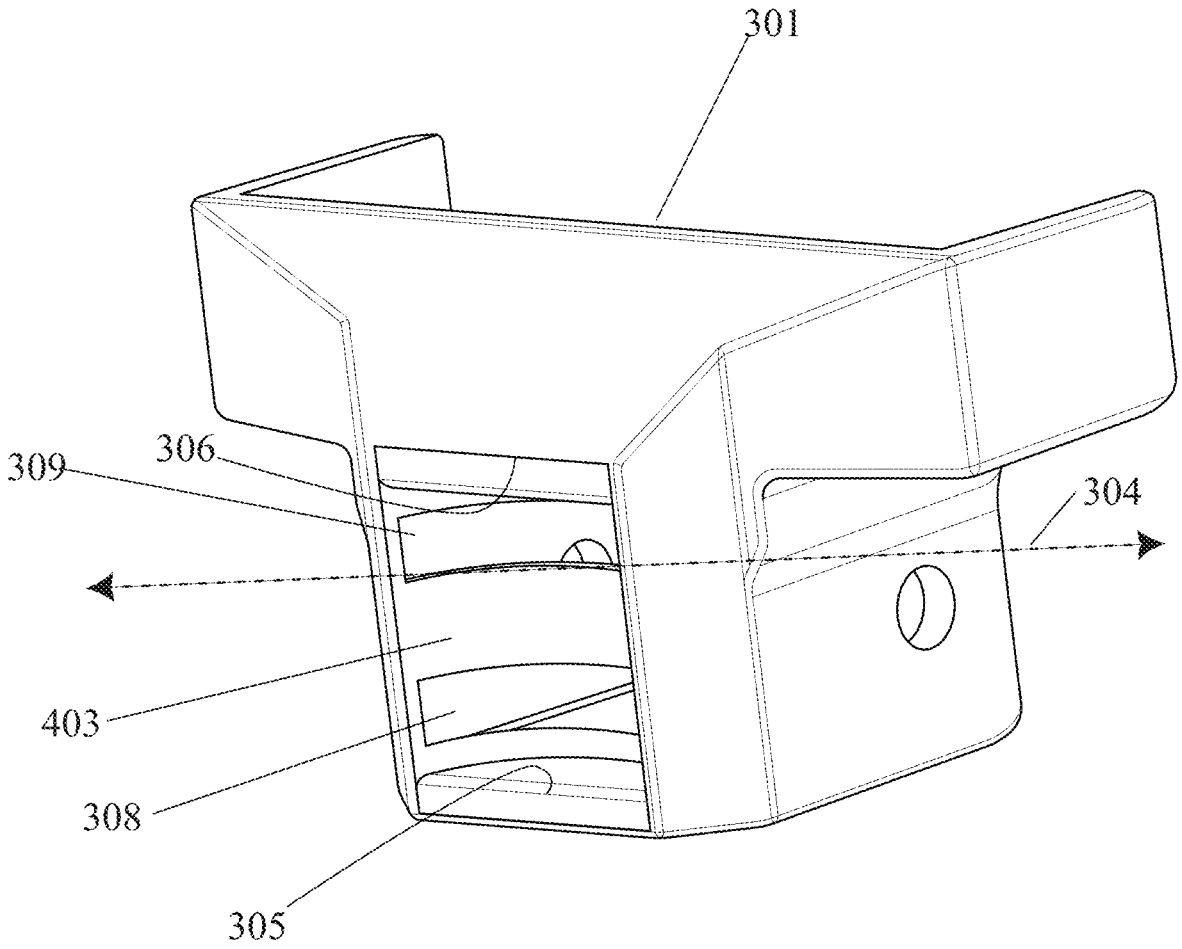
FIG. 4 is an illustration of another view of a second connection member.
Figure 5:
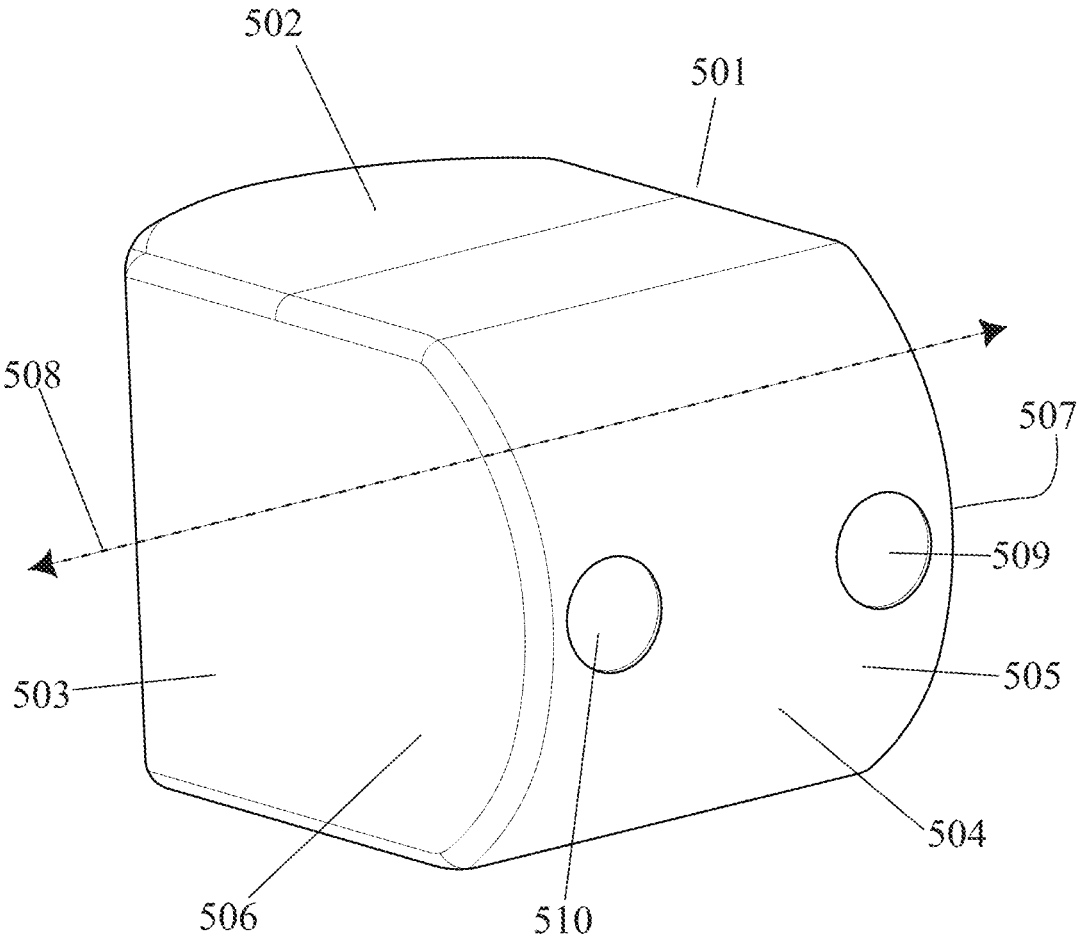
FIG. 5 is an illustration of an articulation member from the perspective of the first curved portion.
Figure 6:
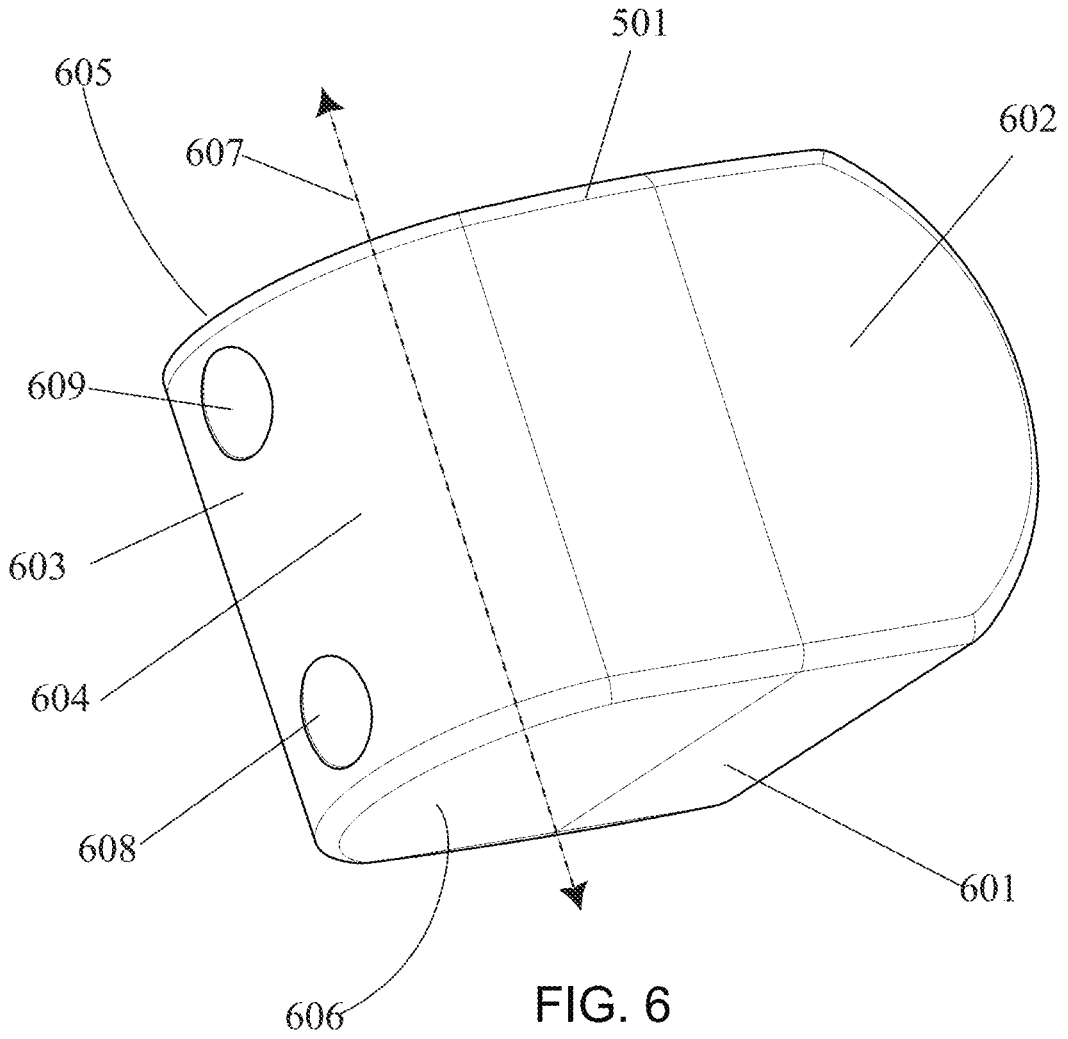
FIG. 6 is an illustration of an articulation member from the perspective of the second curved portion.
Figure 7:
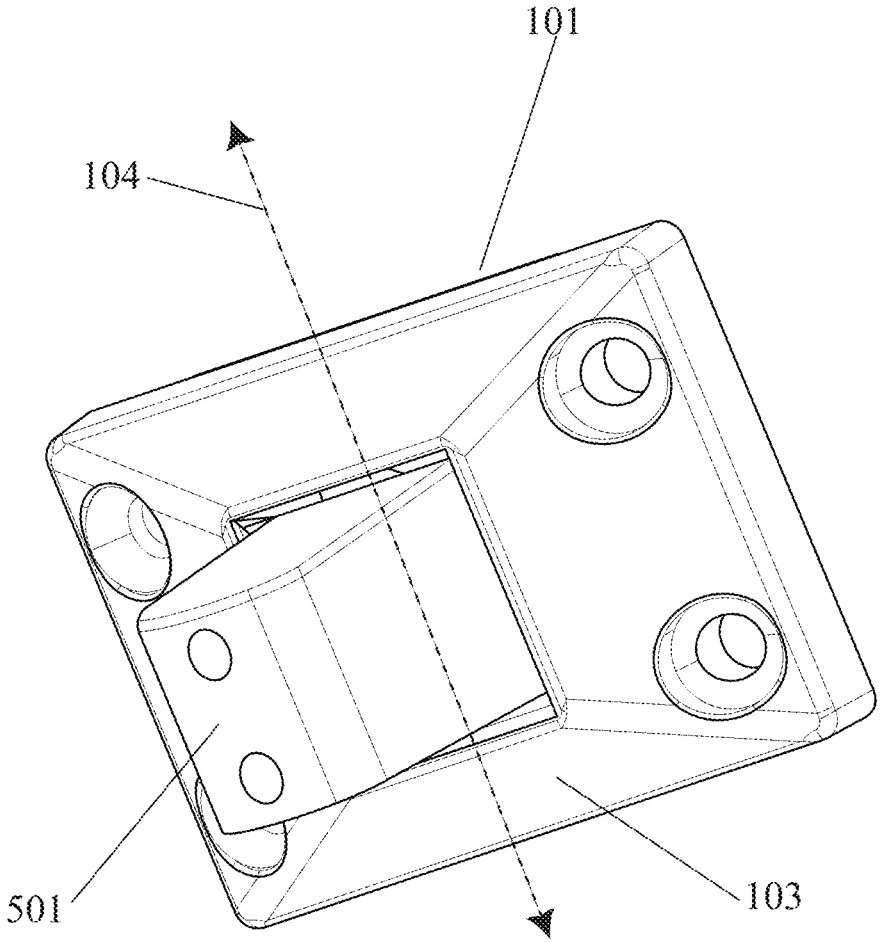
FIG. 7 is an illustration of a first connection piece coupled to the first curved portion of the articulation member.
Figure 8:
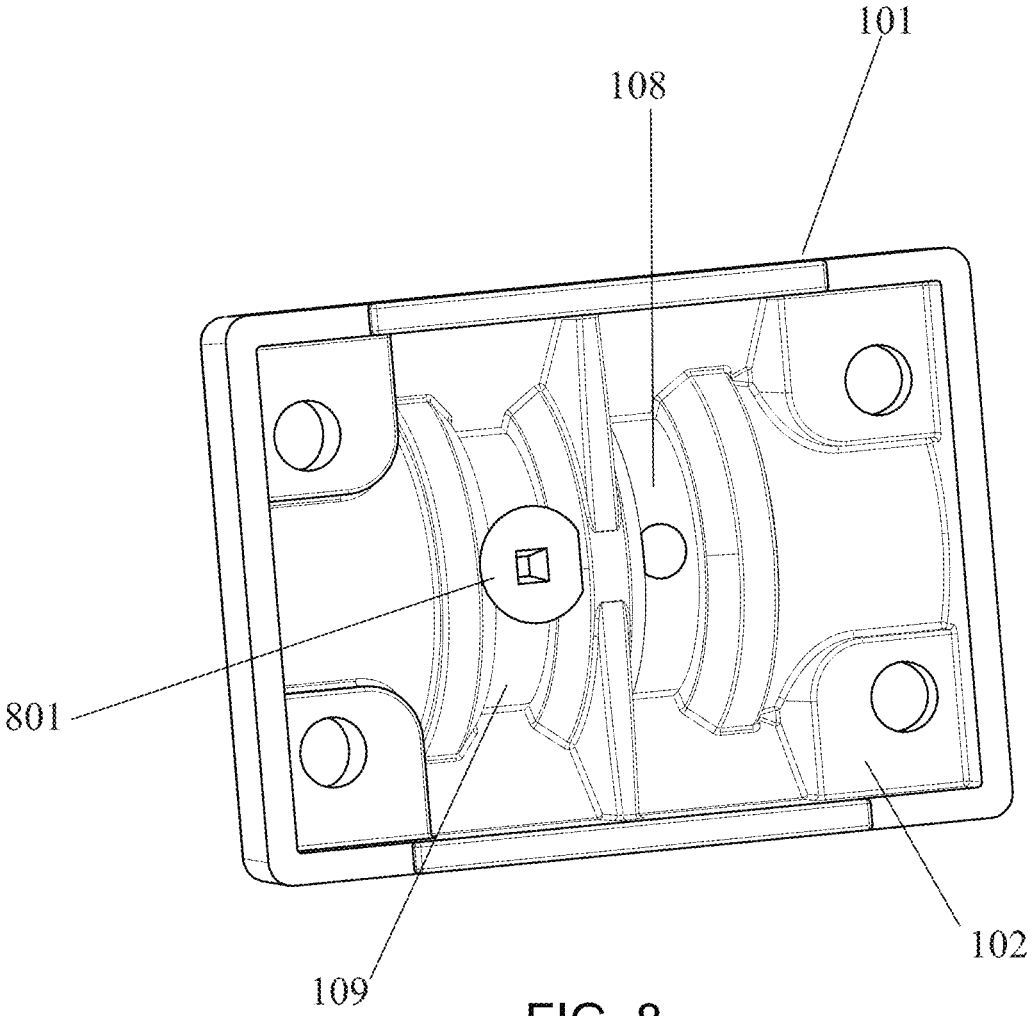
FIG. 8 is an illustration of a rear view of a first connection piece coupled to the first curved portion of the articulation member.
Figure 9:
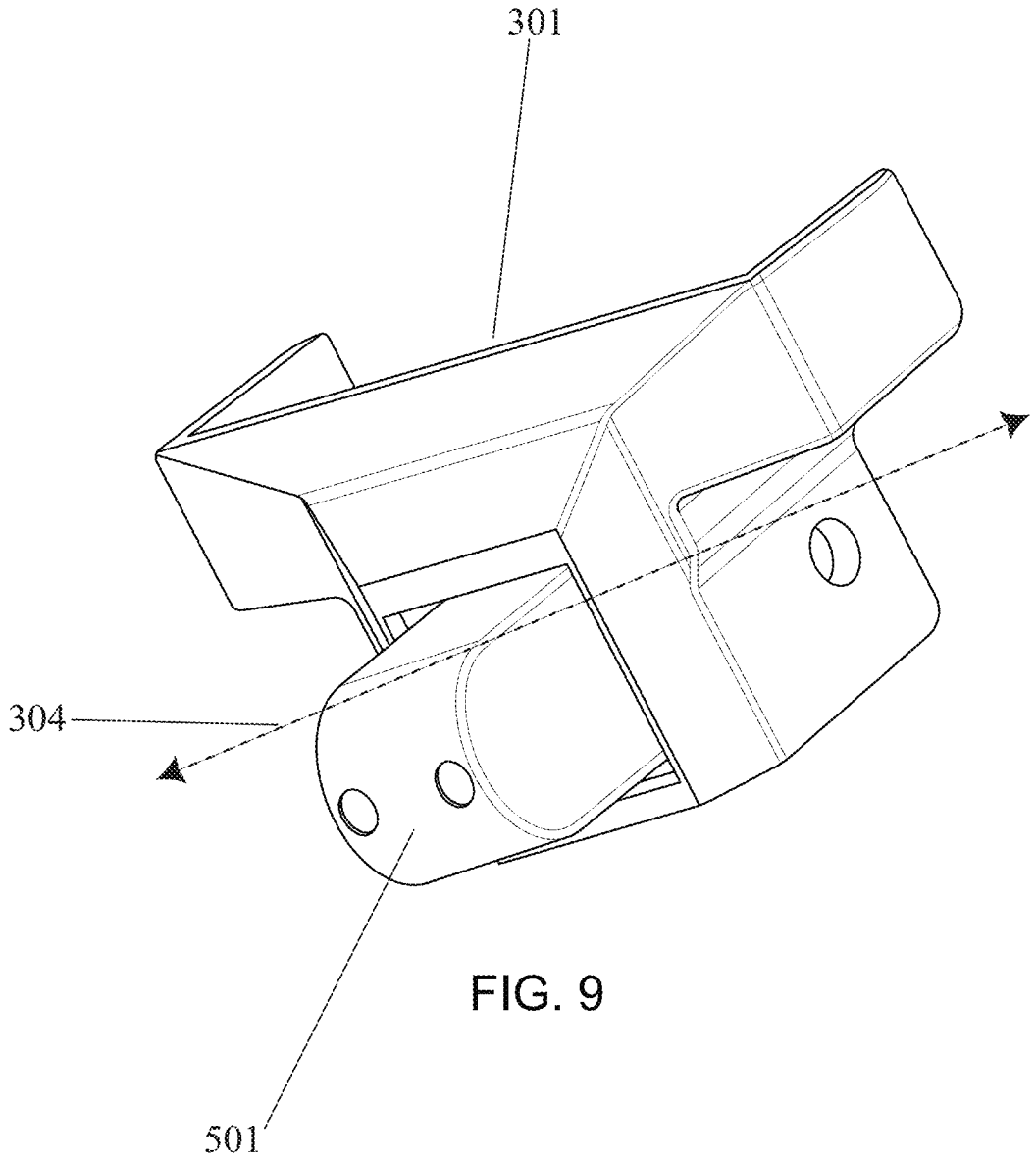
FIG. 9 is an illustration of a second connection piece coupled to the first curved portion of the articulation member.
Figure 10:
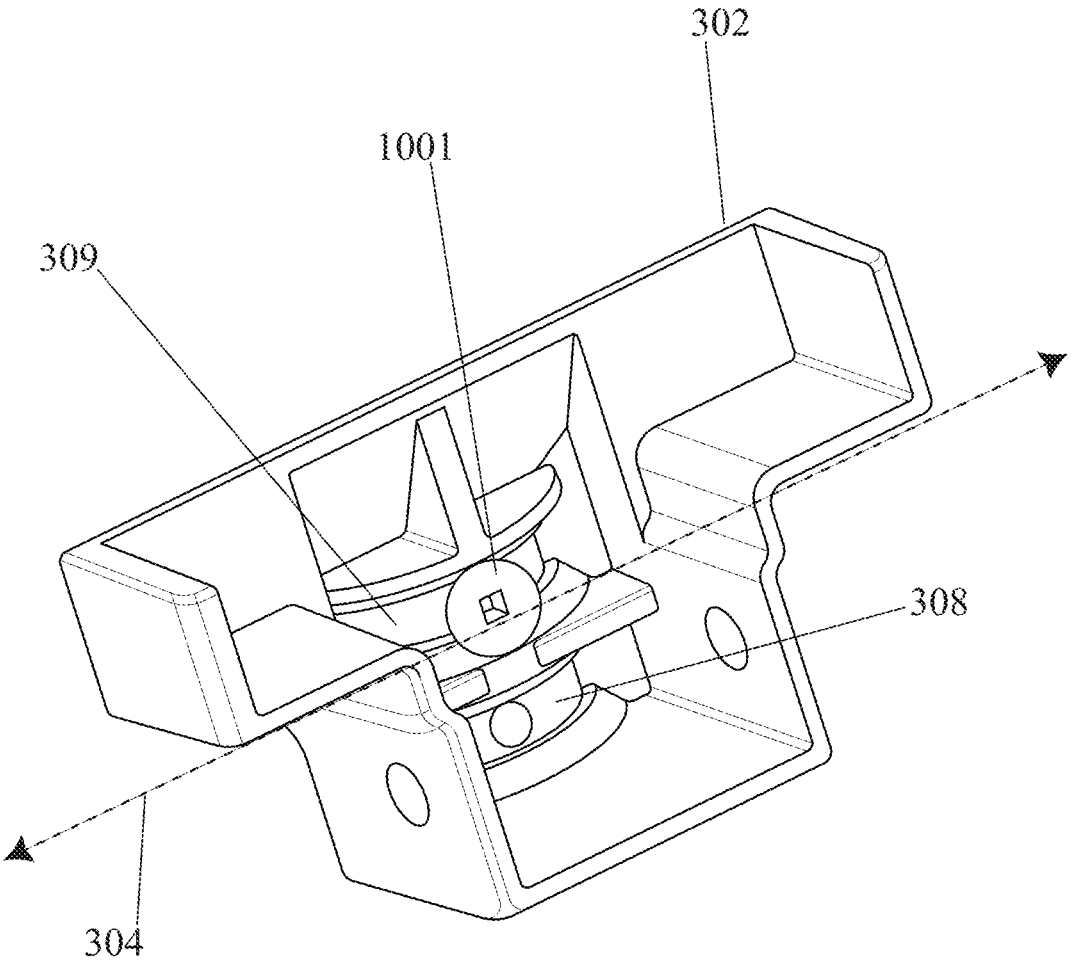
FIG. 10 is an illustration of a rear view of a second connection piece coupled to the second curved portion of the articulation member.
Figure 11:
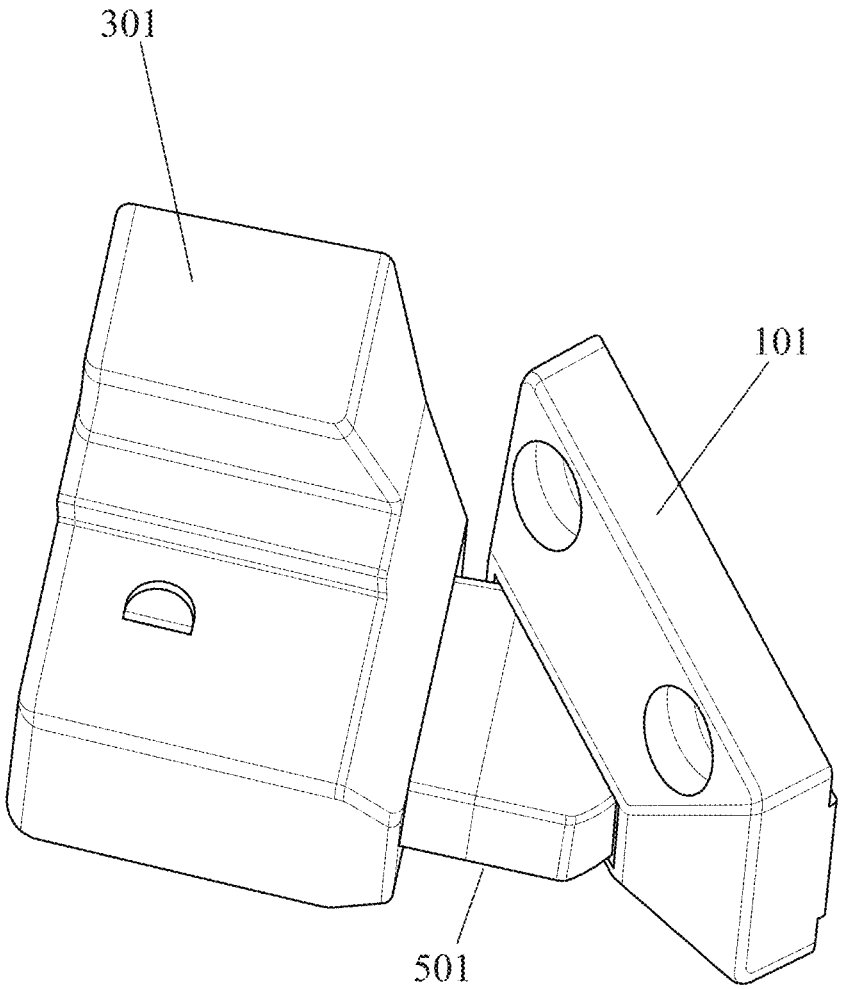
FIG. 11 is an illustration of a fully assembled bracket.
Figure 12:
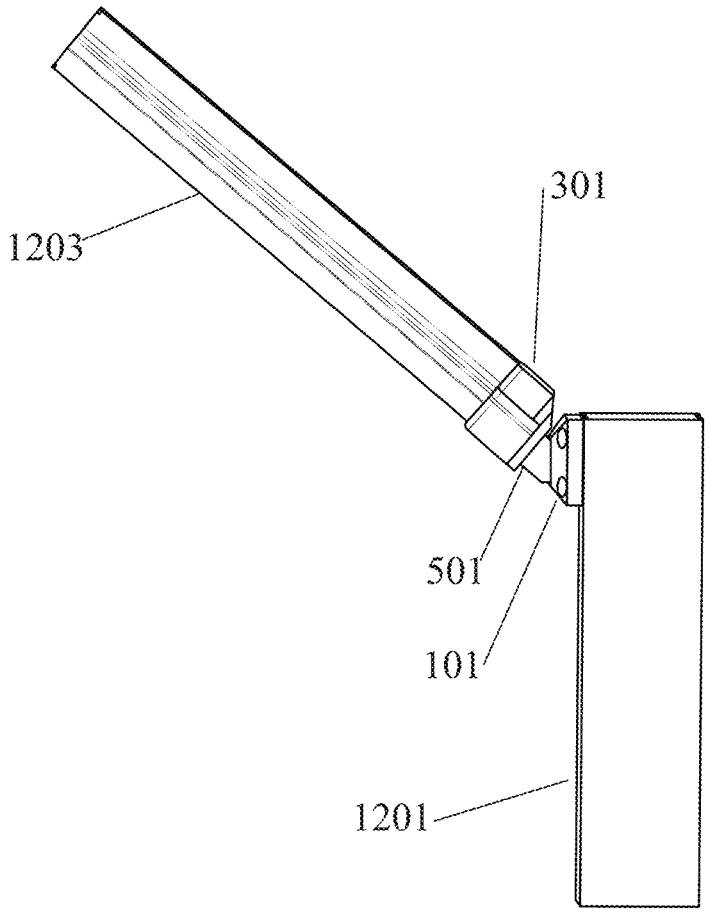
FIG. 12 is an illustration of a fully assembled bracket connecting a post and a rail.

Each reference number consists of three digits. The first digit corresponds to the figure number in which the referenced item is first or best shown. Reference numbers are not necessarily discussed in the order of their appearance in the figures. Drawings are not necessarily to scale. Most, if not all, suitable deck railing systems have a top rail and a bottom rail. As used herein, "rail" may mean any such rail.

A dual-axis swivel bracket is composed of a first connection member (101), a second connection member (301), and an articulation member (501).

The first connection member comprises an external face (102) and an internal face (103). Said internal face further comprises a concave invagination having a longitudinal axis (104) and defining an articulation face having a first flat side (105), a second flat side (106), and a rounded aspect (107). Said rounded aspect further comprises a track (108) having a path largely parallel to the first and second flat sides. A preferred embodiment further comprises a second track (109) having a path parallel to the path of the first track.

The second connection member comprises an external face (302) and an internal face (303). Said internal face further comprises a concave invagination having a longitudinal axis (304) perpendicular to the longitudinal axis of the concave invagination of the second connection member and defining an articulation face having a first flat side (305), a second flat side (306), and a rounded aspect (307). Said rounded aspect further comprises a track (308) having a path largely parallel to the first and second flat sides. A preferred embodiment further comprises a second track (309) having a path parallel to the path of the first track.

The articulation member is comprised of a top (502), a bottom (601), a front (503), a back (602), a side comprising a first curved portion (504), and a side comprising a second curved portion (603).

The first curved portion of the articulation member comprises an outer face (505), said outer face having a largely convex shape such that the curved portion has the shape of a segment of a cylinder bisected from one base of the cylinder (506) to the other base of the cylinder (507). Said curved portion having a longitudinal axis (508). The first curved portion comprises a connection point (509). A preferred embodiment further includes a second connection point (510).

The second portion of the articulation member comprises an outer face (604), said outer face having a largely convex shape such that the curved portion has the shape of a segment of a cylinder bisected from one base of the cylinder (605) to the other base of the cylinder (606). Said curved portion has a longitudinal axis (607) perpendicular to the axis of the longitudinal axis of the first curved portion of the articulation member. The first curved portion comprises a connection point (608). A preferred embodiment further includes a second connection point (609).

The articulation face of the first connection member and the first curved portion of the articulation member are adapted to contact such that the connection point of the first curved portion of the articulation member is aligned with the track of the articulation face of the first connection member.

The articulation face of the second connection member and the second curved portion of the articulation member are adapted to contact such that the connection point of the second curved portion of the articulation member is aligned with the track of the articulation face of the second connection member.

In most highly preferred embodiments, the respective connection points are loosely connected to their paired tracks such that the curved portion of an articulation member in contact the articulation face of a connection member may rotate along the longitudinal axis of the curved portion while attached to said connection member. In certain other embodiments the connection points are adjustable, so the rotation is hampered or eliminated.

In another highly preferred embodiment, said connection points are located on the articulation face of the connection member or members, and the tracks are located on the curved portion or portion of the articulation member.

In a mostly highly preferred embodiment, the external face of the first connection member is adapted to attach to a post, and the external face of the second connection member is adapted to connect to a rail.

To assemble the dual-axis swivel bracket in the most highly preferred form, one would place the first curved portion of the articulation member (504) into the invagination of the internal face of the first connection member (105, 106, 107). With the connection point or points of the articulation member aligned with the tracks of the articulation face, the articulation member and the connection member are secured together by a suitable means such as i.e., a screw or rivet (e.g., 801), so that the articulation member is capable of rotating in relation to the connection member. One would then place the second curved portion of the articulation member (603) into the invagination of the internal face of the second connection member (305, 306, 307) and secure those two members with a suitable such as i.e., a screw or rivet (1100) as previously done with the first curved portion of the articulation member and the first connection member. Once assembled, to use the dual-axis swivel bracket the most anticipated application one would attach the external face of the first connection member to a first post (1201) already in position and attach the external face of the second connection member to the first rail (1202). Similarly, the end of the rail furthest from the first post can be attached to a second post via another dual-axis swivel bracket. The rail (1202) therefore, can be rotated along the longitudinal axis of the first connection member and rotated along the longitudinal axis of the second connection member in relation to the post.

In one highly preferred embodiment, a bracketing system comprises the dual-axis swivel bracket and a shielding member. Said shielding member fits over the assembled bracket covering the interface of the articulation member and the second connection member. In a preferred embodiment, the shielding member is a rectangular prism comprised of a first segment and a second segment. Each said segment having an inner surface and an outer surface. The first segment and second segment are adapted to attach to each other. Following the connection of a post and a rail as described, one could combine the first and second segments of the shielding member. Hence, the shielding member surrounds the area of the interface of the articulation member and the second connection member. The two segments of the shielding member are then connected to each other, and to the rail, improving the aesthetics of the bracketing system.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes, and omissions may be made in the design, operating conditions, and arrangement of the exemplary embodiments without departing from the scope of the present application.

The invention claimed is:

1. A dual-axis swivel bracket comprising a first connection member, a second connection member, and an articulation member;

said articulation member being rotatably attached to the first connection member along a single axis of rotation; and said articulation member being rotatably attached to the second connection member along a single axis of rotation perpendicular to the axis of rotation between the articulation member and the first connection member, wherein:

the articulating portion comprises a first curved region having an outer surface and a longitudinal axis, and a second curved region having an outer surface and a longitudinal axis perpendicular to the longitudinal axis of the first curved region;

the first curved region comprising a connection point; and the second curved region comprising a connection point;

said first connection member comprising an articulation face adapted to contact the outer surface of the first curved region of the articulating portion, and in which the second connection member comprises an articulation face adapted to contact the outer surface of the second curved region of the articulating portion, said articulation face for the first connection member further comprising a track having a path perpendicular to the axis of the first curved surface of the articulating portion, and said articulation face for the second connection member further comprising a track having a path perpendicular to the axis of the second curved surface of the articulating portion;

said connection point of the first curved region of the articulating portion being adapted to interface with the track of the articulation face for the first connection member, said connection point of the second curved region of the articulating portion being adapted to interface with the track of the articulation face for the second connection member.

2. The dual-axis swivel bracket of claim 1 in which the first connection member is adapted to attach to a post having a longitudinal axis, and in which the second connection member is adapted to attach to a rail having a longitudinal axis.

3. The dual-axis swivel bracket of claim 2 in which the first curved surface of the articulating portion is adapted to move within a range of motion in respect to the first connection member in an arc on a plane, said plane being substantially parallel to the longitudinal axis of the post.

4. The dual-axis swivel bracket of claim 3 in which the range of motion is less than 45°.

5. The dual-axis swivel bracket of claim 3 in which the position of the first curved surface of the articulating portion is adapted to be fixed in position along the arc.

6. The dual-axis swivel bracket of claim 2 in which the first curved surface of the articulating portion is adapted to move in respect to the first connection member in an arc on a plane, said plane being substantially perpendicular to the longitudinal axis of the post.

7. The dual-axis swivel bracket of claim 6 in which the arc is less than 45°.

8. The dual-axis swivel bracket of claim 6 in which the position of the first curved surface of the articulating portion is adapted to be fixed in position along the arc.

9. The dual-axis swivel bracket of claim 2 in which said post is substantially comprised of wood.

10. The dual-axis swivel bracket of claim 9 in which said rail is substantially comprised of wood.

* * * * *